US006364419B1

(12) United States Patent
Cannizzo et al.

(10) Patent No.: US 6,364,419 B1
(45) Date of Patent: Apr. 2, 2002

(54) SYSTEM FOR WORKING THE SURFACE OF A ROAD

(76) Inventors: Steven Cannizzo, 5 Joan Dr., Montville, NJ (US) 07045; Leroy I. Robinson, 95 Harvard Ave., Maplewood, NJ (US) 07040

( * ) Notice: Subject to any disclaimer, the term of this patent is extended or adjusted under 35 U.S.C. 154(b) by 0 days.

(21) Appl. No.: 09/138,428

(22) Filed: Aug. 24, 1998

Related U.S. Application Data

(60) Provisional application No. 60/056,953, filed on Aug. 26, 1997.

(51) Int. Cl.[7] ..... E01C 23/16; E01C 23/09

(52) U.S. Cl. ..... 299/39.6; 299/39.3; 299/36.1; 299/41.1; 404/94

(58) Field of Search ..... 404/90, 91, 93, 404/94; 296/52; 299/36.1, 39.1, 39.3, 39.4, 39.6, 41.1

(56) References Cited

U.S. PATENT DOCUMENTS

| | | | | |
|---|---|---|---|---|
| 4,174,184 A | | 11/1979 | Heenan | 404/72 |
| 4,463,989 A | | 8/1984 | Kennedy | 299/39.4 |
| 4,729,712 A | | 3/1988 | Corley, Jr. | 414/626 |
| 4,797,025 A | | 1/1989 | Kennedy | 404/90 |
| 4,848,958 A | | 7/1989 | Sheldon | 404/11 |
| 4,900,094 A | | 2/1990 | Sergeant | 299/39.6 |
| 4,930,969 A | | 6/1990 | Langer | 414/540 |
| 5,094,565 A | | 3/1992 | Johnson | 404/75 |
| 5,391,017 A | * | 2/1995 | Thomas et al. | 404/94 |
| 5,421,669 A | | 6/1995 | Bertrand | 404/90 |
| 5,440,838 A | | 8/1995 | Lesser | 49/340 |
| 5,492,431 A | | 2/1996 | Rasmussen et al. | 404/75 |
| 5,695,299 A | * | 12/1997 | Thomas et al. | 404/94 |

* cited by examiner

*Primary Examiner*—David Bagnell
*Assistant Examiner*—John Kreck
(74) *Attorney, Agent, or Firm*—Klauber & Jackson

(57) ABSTRACT

An assembly is provided for excavating cavities in a road surface for a variety of purposes, among them, the formation of rumble strips, the installation of light reflective road markers, the milling of potholes, boring of holes for various purposes and the like. The system is used in combination with a vehicle having a motor powered vertically movable rear lift gate which in use defines a vertically displaceable substantially horizontal platform. A cutting apparatus is secured to the upward facing surface of the lift gate with the actual cutting portion being mounted on a rotatable drive shaft extending laterally of the gate, such that the cutting portion projects at least partially below the bottom surface of the lift gate, whereby with the gate in a lowered position, the cutting portion can engage the surface of the road on which the vehicle resides. A motor is secured to the upper surface of the gate powers the drive shaft. The vertical position of the lift gate is adjustible with respect to the surface of said road, to control the depth of cut and thus the degree of excavation produced by the cutting apparatus.

10 Claims, 11 Drawing Sheets

SYSTEM FOR WORKING THE SURFACE OF A ROAD

RELATED APPLICATIONS

This application is based upon provisional patent application Ser. No. 60/056,953, filed Aug. 26, 1997.

FIELD OF INVENTION

This invention relates generally to road construction and maintenance apparatus, and more specifically relates to a system for working or generally cutting into the surface of a road, that is, to produce cavities or openings in the pavement surface for various purposes, among them, the installation of reflectors, the formation of rumble strips in the road surface, the boring of holes in the road surface, the cutting of a striping, the milling of potholes or generally to otherwise physically affect the road surface.

BACKGROUND OF INVENTION

There are many operations that are needed to be performed through working or in some way cutting into or affecting the surface of a road. For example, light reflective lane and border markers have come into ever increasing use on modem roads and highways. These well-known devices are installed in the pavement at spaced intervals extending in the direction of vehicular travel, so that a motorist traveling under darkened or inclement weather conditions may readily perceive the thereby defined lanes and/or borders of the roadway.

An example of the type of reflective device which is commonly used for the above purposes may be found in U.S. Pat. No. 4,174,184. Such device includes a pair of parallel elongated, laterally spaced apart keel members and an intervening portion having an arcuate part-cylindrical convex bottom portion, and an upper portion which receives a reflector assembly. The 4,174,184 patent also discloses a typical type of apparatus which can be used to form cavities in the road surface for receiving markers of the type discussed. Such apparatus includes a plurality of circular cutting or milling blades mounted on a common shaft. The outer blades are of an enlarged diameter as compared to the inner blades so that a cut can be formed in the road for matching the bottom shape of the marker. The shaft is in turn mounted on a wheeled cart that is towed to the location of each cut, where the cart is positioned so that the resulting cavity is at the desired locale for the emplaced marker. The assembly of rotatable circular blades (powered by an internal combustion engine, or hydraulic motor or the like) is placed in initial tangential contract with the road surface, and as it rotates controllably descends to the desired depth of cut. Because of this descending action, the assembly is sometimes referred to as a "plunge saw", a term which at times will be used in the present specification.

Particularly in view of increased interest and awareness in road safety measures, the need for installing large numbers of the foregoing road reflectors has risen greatly. This is not to even mention the need to reinstall new reflective markers to replace or augment those which have become damaged as a result of normal weathering and wear and tear, particularly where extensive snow plowing of the road surface is a factor. While towed carts and the like are quite suitable for providing small numbers of installations, they do not lend themselves to large scale activities. The use of such rudimentary apparatus in turn leads to excessive installation costs for the many road building and installation agencies which seek to exploit the many safety advantages of the in-road installed type of light reflectors.

In several instances apparatus have been disclosed which endeavor to alleviate the disadvantages of simple towed and similar devices by providing automated plunge saws and the like which are mounted to a truck or similar vehicle. A very simple arrangement of this type is shown in U.S. Pat. No. 4,797,025, where a self-propelled cart carries a series of rotating blades to cut desired pavement slots. The blade drive shaft is powered by an hydraulic motor, and manually adjustable means enable the operator to set the depth of cut.

In U.S. Pat. No. 4,463,989 a portable road cutting machine is disclosed which is mounted on the forward end of a conventional truck body. The apparatus incorporates many hydraulic components, such as a large hydraulic reservoir, hydraulic lines and electronic hydraulic valves.

In U.S. Pat. No. 5,421,669, a further machine is disclosed for producing cavities in a roadway surface for installation of markers. The machine is mounted on a support base forming part of a powered vehicle that can be driven on the roadway surface where the road markers are to be installed. As in the 4,463,989 patent, heavy reliance is placed on numerous hydraulic components. Malfunctioning of such components can occur all too easily, e.g. a valve may remain open or closed, which can cause serious damage to the equipment or even the operator. Furthermore, in both of these truck associated systems the apparatus is so intimately connected with the vehicular carrier that dismantling of the system is a very complex and time-consuming task.

As examples of other functions that work or in some way affect the surface of a road, there is often formed in road surfaces, a series of grooves, commonly referred to as rumble strips, and which are formed by the use of an specially constructed apparatus, one of which is shown and described in U.S. Pat. No. 5,094,565 where a cutting tool is used having a plurality of cutting heads that can be used to form the rumble strip. As can be seen in that patent, a particular machine is dedicated to the formation of the rumble grooves and which forms a plurality of grooves simultaneously by milling the groves into the road surface.

As a further example of a road working function and apparatus, various boring machines are currently used to work the surface of a road and may be used to simply bore holes of a desired size to install different styles of reflectors and the like or can be used for the preparation of potholes so that the potholes are bored out to receive and hold the fresh asphalt in the alleviation of the pothole.

SUMMARY OF INVENTION

Now in accordance with the present invention, a system is provided for working the surface of a road to carry out variety of the aforementioned functions to that road, including the installation of reflectors, the formation of rumble strips, the boring of holes, cutting of line striping, pot hole milling by or for a variety of other functions that cut or work the road surface where the working apparatus requires some vertical adjustment to determine the desired depth of penetration. The system is defined in combination with a vehicle having a motor powered vertically movable rear lift gate which, in use, defines a vertically displaceable substantially horizontal platform. The particular rotating road working apparatus is secured to the upward facing surface of the lift gate with the apparatus itself being mounted on a rotatable drive shaft extending laterally of the gate. In one of the various embodiments, a series of cutting blades can be functionally connected to the rotatable drive shaft, and the cutting blades at least partially projecting below the bottom surface of the lift gate, whereby with the gate in a lowered position, the saw blades can engage the surface of the road on which the vehicle resides. In an alternative embodiment, the rotatable drive shaft may be connected to a differential coupling so that the horizontal rotating shaft can be converted to a vertical rotating shaft and that apparatus used to bore holes in the surface of the road or to mill the asphalt in the excavation of potholes. In any instance, a motor means is secured to the upper surface of the gate, and is connected to power the drive shaft; and means are provided to selectively adjust the vertical position of the lift gate with respect to the surface of said road, to thereby control the depth of cut and thus the degree of excavation produced by the particular road working apparatus.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
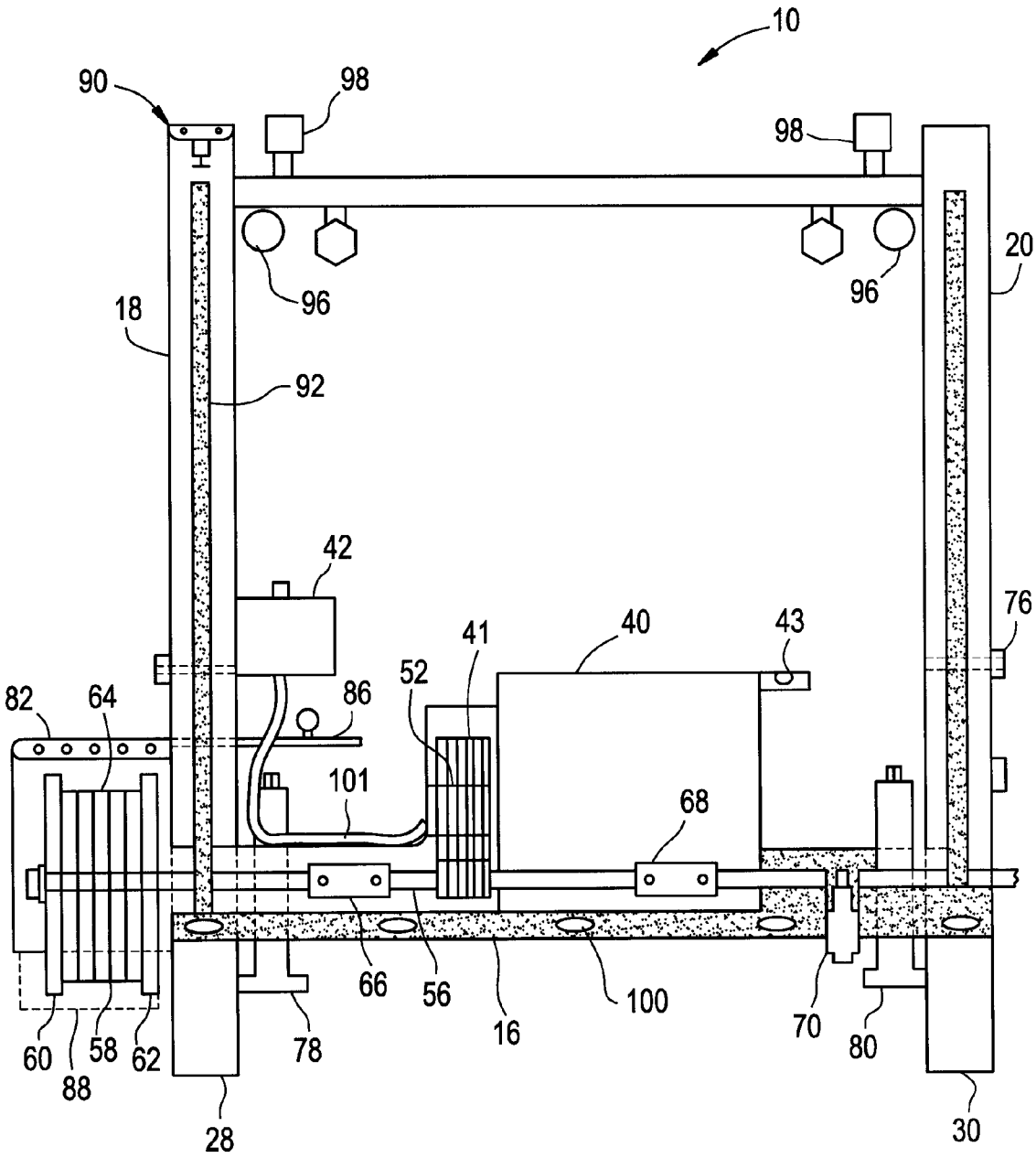
FIG. 1 is a schematic rear view of a system in accordance with the present invention, for producing cavities in a road surface into which reflective road markers are to be received.
Figure 2:
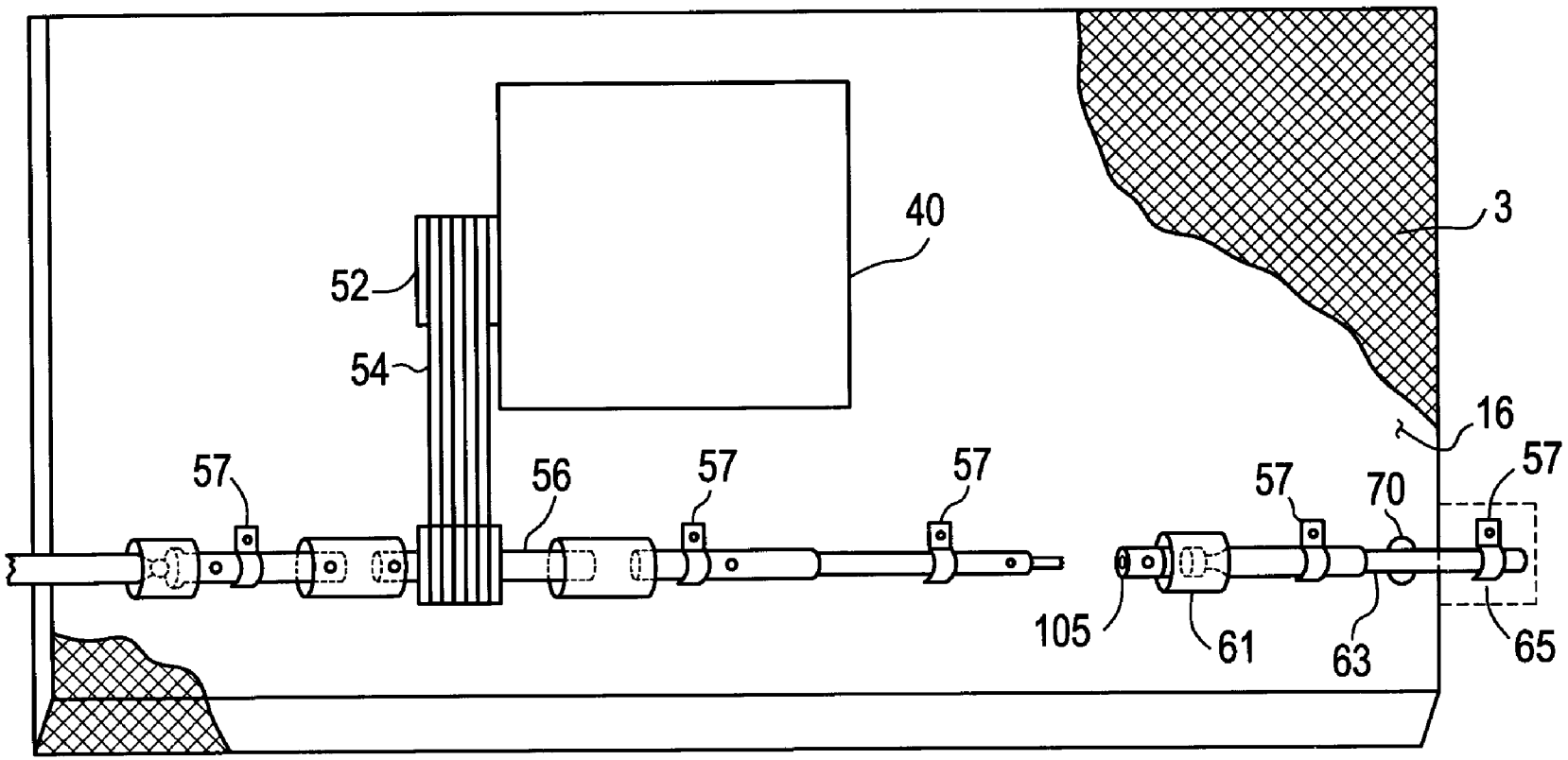
FIG. 2 is a top plan view of the system of FIG. 1.
Figure 3:
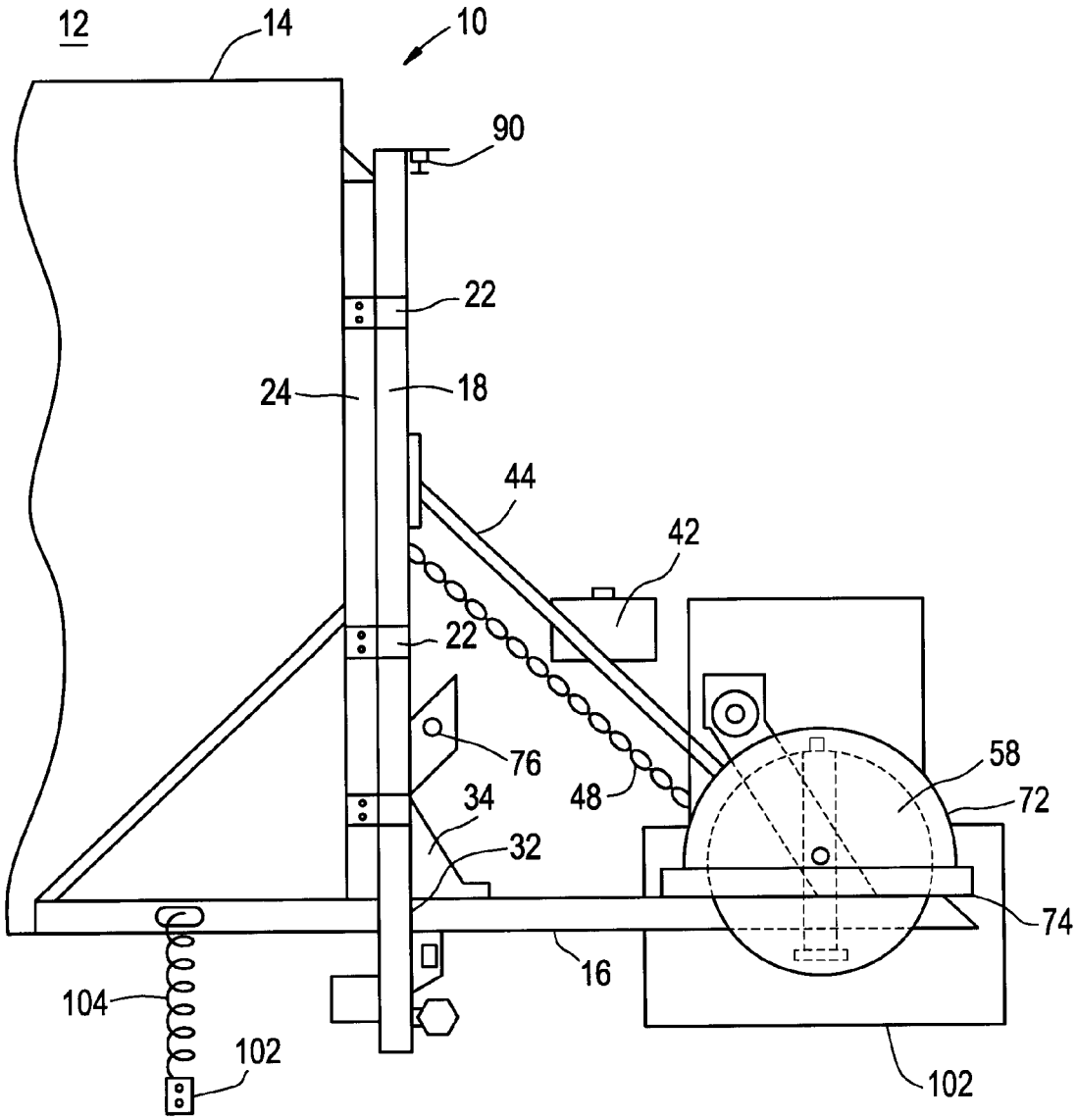
FIG. 3 is a left end view of the system of FIG. 1.
Figure 4:
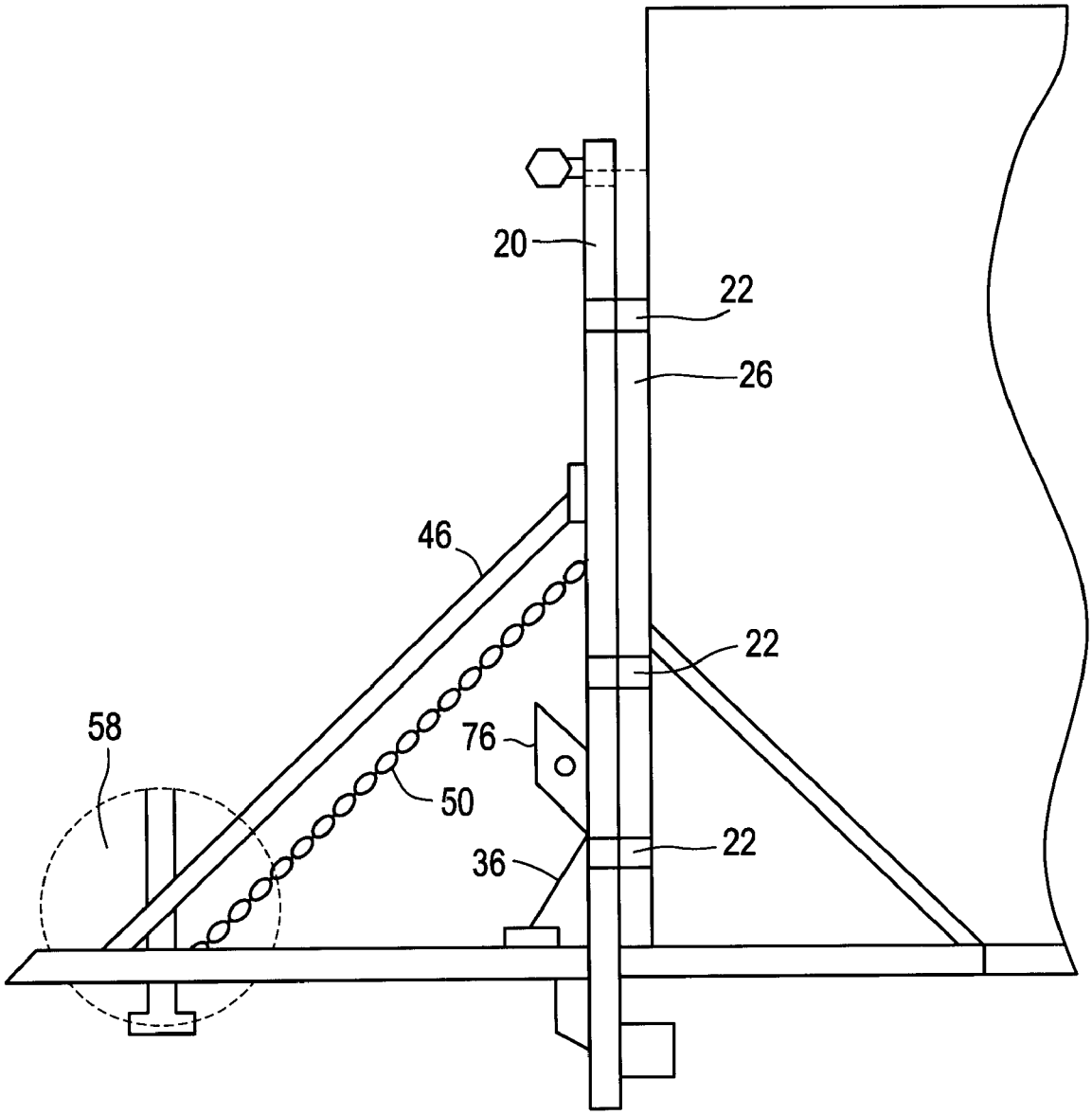
FIG. 4 is a right end view of the system of FIG. 1.

FIG. 1, which may be viewed simultaneously with FIGS. 2, 3, 4 and 5 schematically depicts a system 10 in accordance with the present invention for producing cavities in a road surface into which reflective road markers are to be received. System 10 is a combination which includes a vehicle 12 such as a truck, a portion of which is shown at 14 (FIGS. 3 and 4), which vehicle is provided with a lift gate 16. The lift gate 16 is per se a well-known device for use with trucks and other vehicles to aid in loading and unloading. In use, such a conventional lift gate is placed (if not already so oriented) in a horizontal plane to define a platform for receiving loads. The lift gate is movable vertically between desired positions of elevation so that loads may be moved between the truck bed and a loading platform or other surface. This vertical movement is accomplished by electric or hydraulic motors which are actuated by an operator. Various types of lift systems are known for lift gates. A preferred arrangement for the present invention is one based on a rail lift. In this arrangement the platform is supported at the platform's edge closest to the vehicle by a pair of elevator members which are vertically movable in opposing vertical rails. Support members at or toward the platform's edge furthest away from the vehicle are attached to a further pair of elevator members which are vertically movable in the said rails. In this manner the platform is raised from each of the platform's four corners, thereby providing a more uniform lift.

Figure 5:
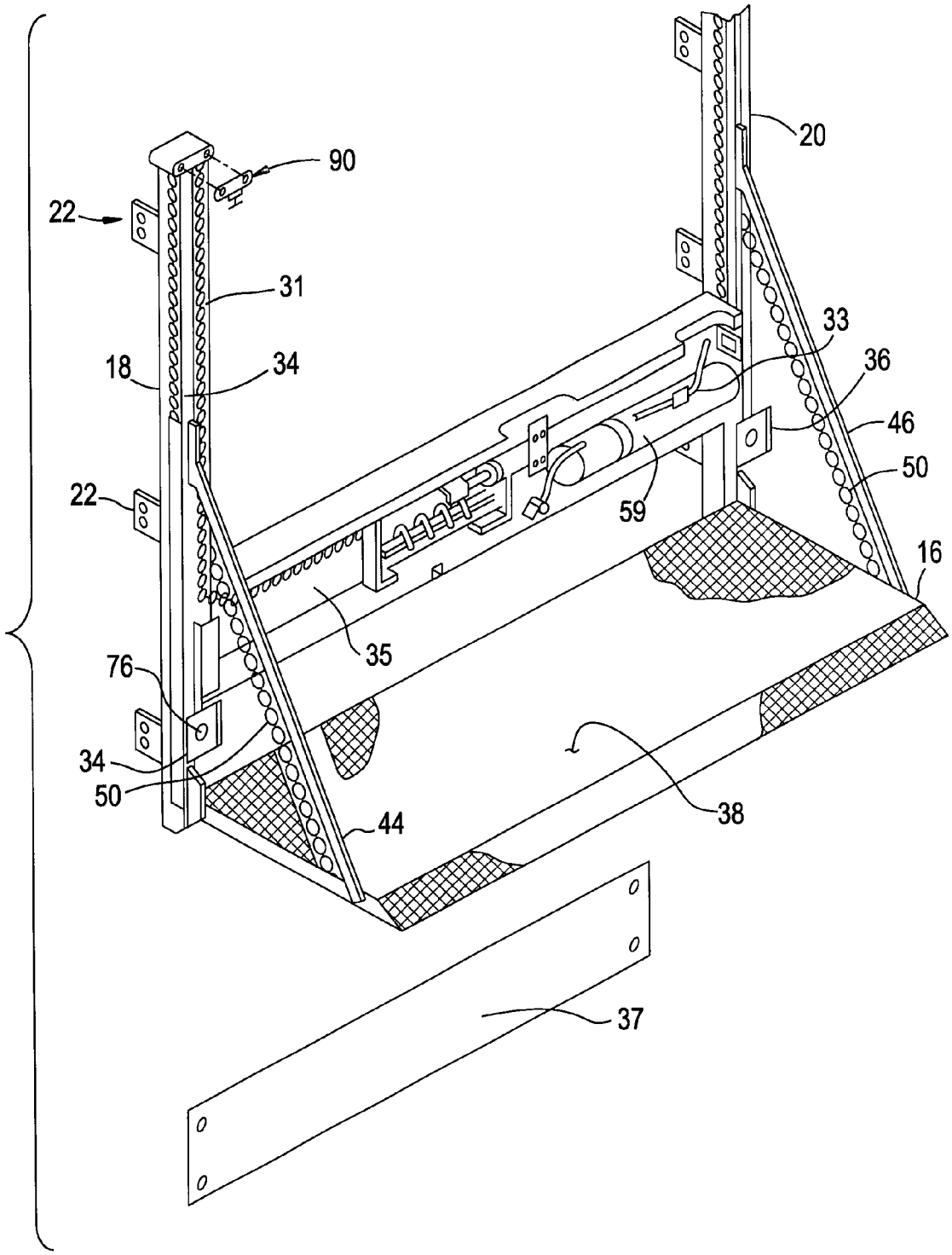
FIG. 5 is a perspective, partially broken-away view showing details of the vertical support rails and elevatable lift gate. The gate is shown without the mounted elements present.
Figure 6:
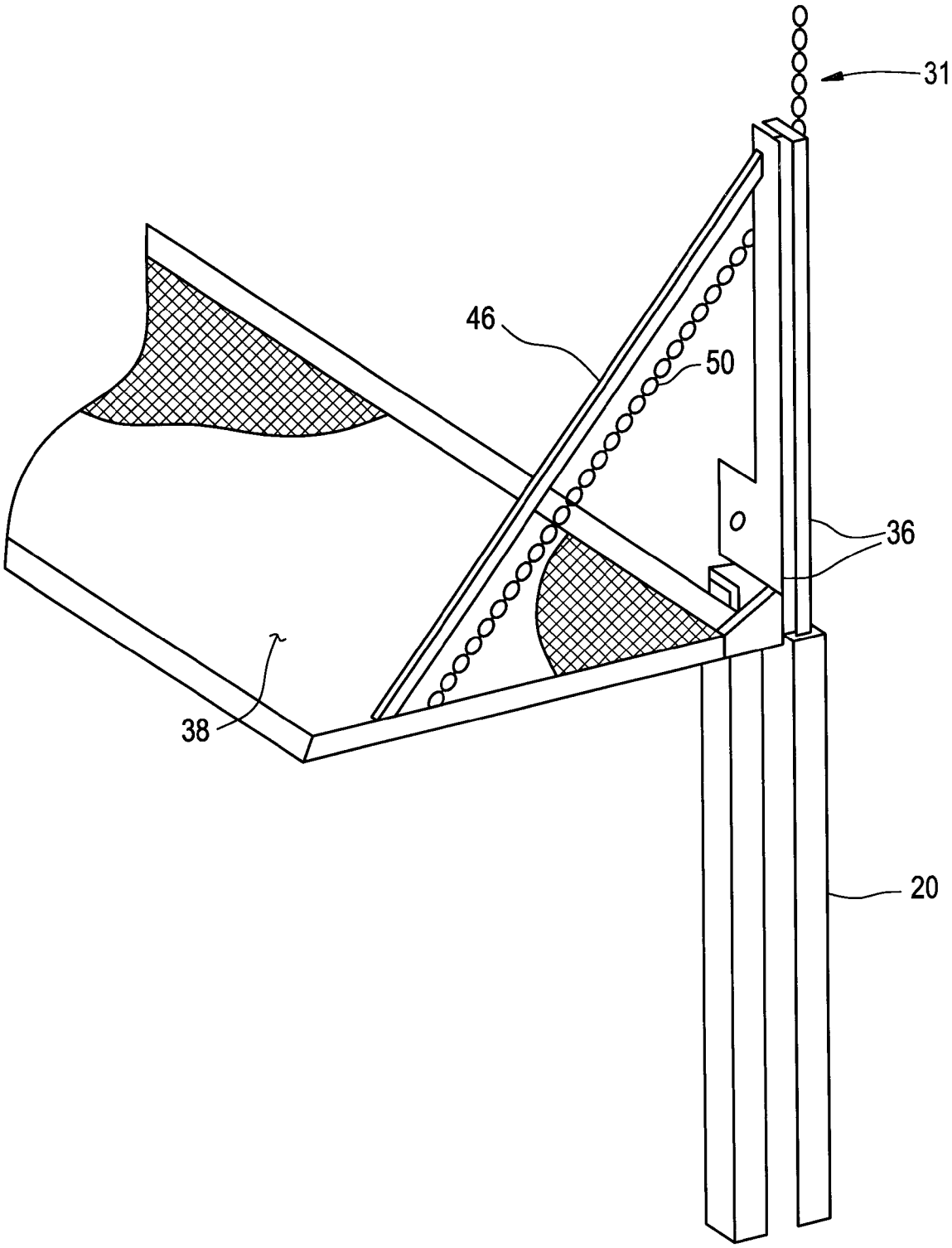
FIG. 6 is a partially broken away view of the rail slider assembly that lifts the tail gate.
Figure 7:
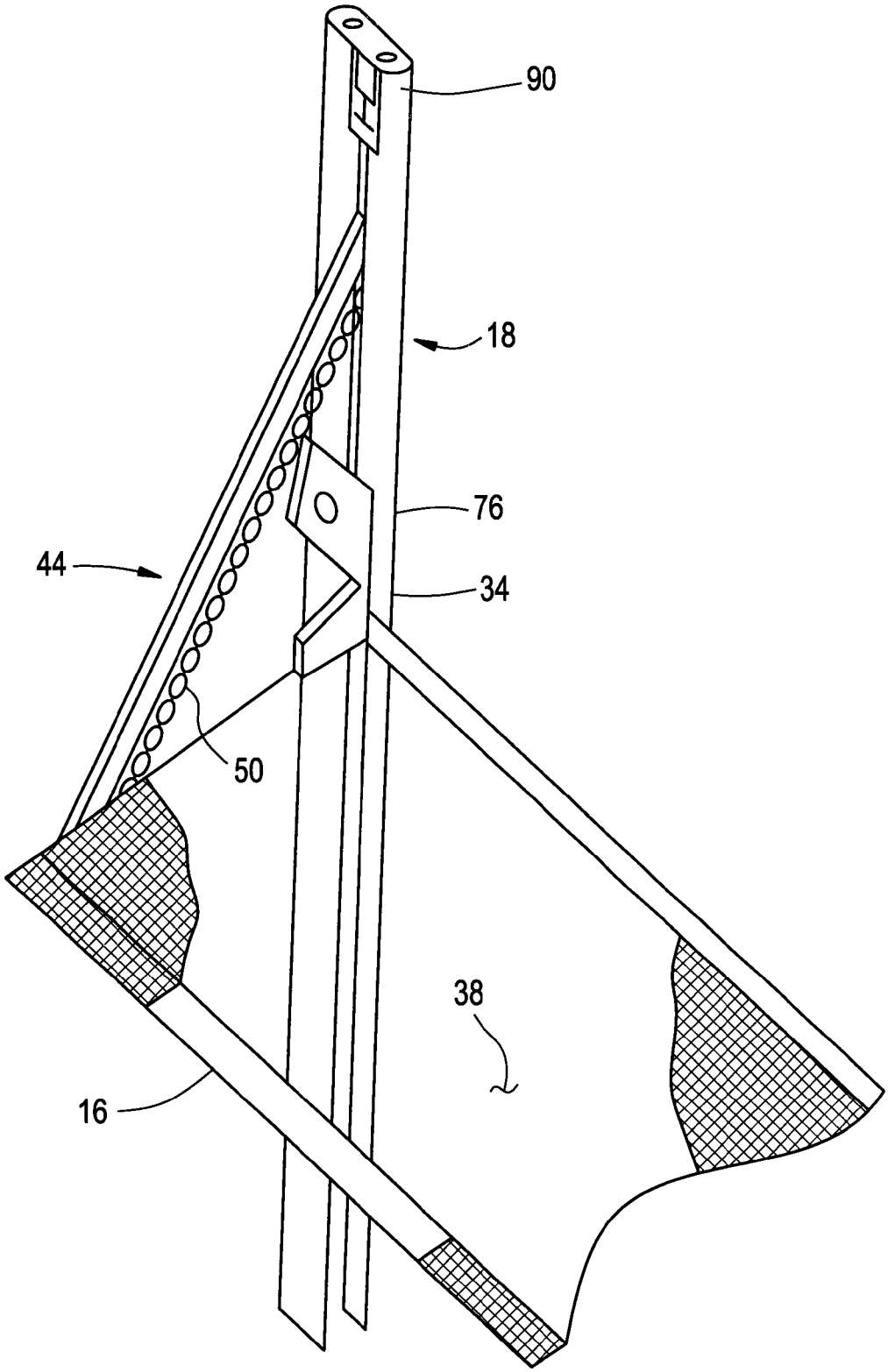
FIG. 7 is a partially broken away view of the left side slider assembly with safety switch.

In the present invention, a pair of vertical rails 18, 20 are secured to the rear of vehicle 12 by being welded or otherwise secured by brackets 22 to upright members 24, 26 at the rear of the vehicle 12. As best seen in FIG. 5, a pair of movable supports 34, 36 are received within vertical rails 18, 20 for vertical movement. The lift gate 16 is attached at its inner end 32 to movable supports 34, 36 movable within the vertical rails 18, 20 by the drive chain 31. Support bars 44 and 46 extend between the movable supports 34, 36 and lift gate 16; and safety chains 50 are also provided between the same elements to provide an added safety measure. Accordingly the lift gate 16 is movable vertically within the vertical rails 18, 20. Lift gates and chain drive systems for same which are useable in the present invention are available from several sources, such as Thieman Life Gate Company of Celina, Ohio. The motive means for lifting the movable rails and lift gate is generally conventional, and may comprise an electric motor which is powered by the vehicle or other battery, and a chain and gear drive. Noteworthy for the present invention is that such power is only required for elevating lift gate 16; the gate descends gravitationally under its own weight and the weight of such load as may be present on the lift gate 16, which can be regulated by a hydraulic flow controller 33 that is installed in line inside the access panel 35, the cover 37 of which is removed in FIG. 5 to show the internal components.

In accordance with the present invention, essentially all major active elements of the system 10, including the powering means, are directly mounted on platform 38 of lift gate 16, so that such major elements may move vertically therewith to effect upon descent the desired action to the surface of the road. More specifically a motor means such as a compact gasoline or diesel driven engine 40 is secured to platform 38 of lift gate 16. A fuel tank 42 is mounted to the upright member 24 together with fuel lines 101 which connect the fuel tank (42 to engine 40. The drive shaft 52 of engine 40 transfers power through pulley 41 and drive belts 54 to the power shaft 56, which as best seen in FIG. 1 extends to one side of vehicle 12 and lift gate 16. In accordance with the first embodiment, the power shaft 56 carries at its projecting end a generally conventional milling saw assembly 58. Such milling saw assembly 58 includes a series of blades mounted for rotation on the shaft 56, i.e. an outer pair of blades 60 and 62 of an enlarged diameter, and a series of inner blades 64 of a reduced diameter. The various blades, and the milling saw assembly 58 are per se all conventional, and have been used in the prior art to excavate the cavities which are of interest to the present embodiment. In the system 10 depicted, a single milling saw assembly 58 is shown to reside at one side of the vehicle 12, although in practice a further assembly can be mounted at the other lateral side of vehicle 12, and driven by the same power shaft 56. See FIG. 2, where power shaft 56 (journaled in block bearings 57) is connected to a splined adjustable drive shaft 105 (power shaft 56 is shown broken away in FIG. 2) which may be connected to a splined yoke shaft 105, thence through universal joint 61 and shaft 63 to a removable shaft hold down extension 65, to support extended shaft and hold down block bearing 57, to enable different milling lengths for the total shaft length. This enables the user to excavate pairs of cavities simultaneously for selected spacings between the members of the pair, e.g. for 10 or 12 foot wide, etc. traffic lanes. It will be seen in FIG. 1 that two slip couplings 66, 68 are inserted in the power shaft drive train, which enables different driving arrangements as required for a given project. A drive shaft lifting adjuster 70 is also provided to enable adjustment for possible differences in roadway distance from the shaft on alternate sides of the vehicle. Side and top blade guards 72 and 74 surround exposed portions of the blades to further protect operators of the present system.

In use, the engine 40 is operated via throttle 43 to effect turning of the milling saw assembly 58. Power is preferably transmitted through the one or more couplings 66, 68, and a clutch may be incorporated in the power train to increase control and safety. Initially the lift gate 16 is in an elevated position whereby the milling saw assembly 58 is out of contact with the road surface. The raised position is of course also appropriate for transport to the work site, and when moving between areas at the site where installation of reflectors is to be carried out. A removable transport locking pin 76 is provided as a safety measure to assure that the raised lift gate is not accidentally lowered prematurely or during transport. A pair of depth adjusters 78 and 80 are mounted through the platform 38, with the lowermost feet of the depth adjusters 78,80 being manually displaceable by the system operator to desired vertical positions. This provides a limiting means for downward descent of lift gate 16 with the milling saw assembly 58, thereby to control the depth of the cut in the road surface.

During the descent of lift gate 16, the movable lift gate 16 slides downwardly under gravitational force. The rate of descent is controlled by a controlled hydraulic bleed from the piston and cylinder arrangement 59, the hydraulic fluid displaced from the cylinder during the descent being bled through a control valve at hydraulic flow controller 33, the setting of which thus regulates the rate of platform descent and thereby the rate at which the rotating cutting blades descend into the roadway surface. During cutting, a stream of cooling water is fed to the cutting blades via a nozzle 82 in order to prevent damage to the expensive (usually diamond studded) cutting surfaces. The water is fed gravitationally from a tank (not shown) mounted in the truck bed. Water flow may be monitored by the water flow meter 86. Safety mud flaps are also provided at 88 and 102 to prevent throwing off of materials from the rotating blades as the cuts are made. In the absence of these flaps, mud and road materials can be ejected toward operators or other workers resulting in injury or worse. Subsequent to the cut being effected, the movable platform 38 is raised with the lift gate 16. Upward movement of the lift gate 16 is limited by a limit switch 90 which is actuated by contact with the end face of support bar 44 with the ascending movable support 34.

Since the production of the cuts in the roadway surface is an operation often carried out at night so as to minimize interference with traffic, a series of lights may be provided as at 96, as well as strobe lights 98. Reflectors as at 100 are also provided at the rear of the system as an added safety measure.

Control of the entire operation of the system 10 may be carried out by a control box 103, which is connected to the various control switches through a flexible cable 104.

As can readily be seen, the aforementioned embodiment was describes with the use of a milling saw assembly, however, as can also be seen, the milling saw assembly can be replaced with a variety of other rotating apparati, including a narrow rotating saw to cut a narrow strip into the surface of the pavement for use in the installation of a 3M adhesive yellow tape that interfits with the depression cut by the saw. In such case, the depression or taper can be cut into the surface of the road in a width of about one eighth of an inch for the installation of such striping and therefore the milling saw can readily be replaced with the appropriate width saw without departing from the spirit of the present invention. Additionally, other sizes of milling saws can be used and in such case, the milling saws can be readily used to excavate pot holes easily and without the need to provide a separate movable apparatus to move into position, carry out the milling and them be manually movable from the location.

Figure 8:
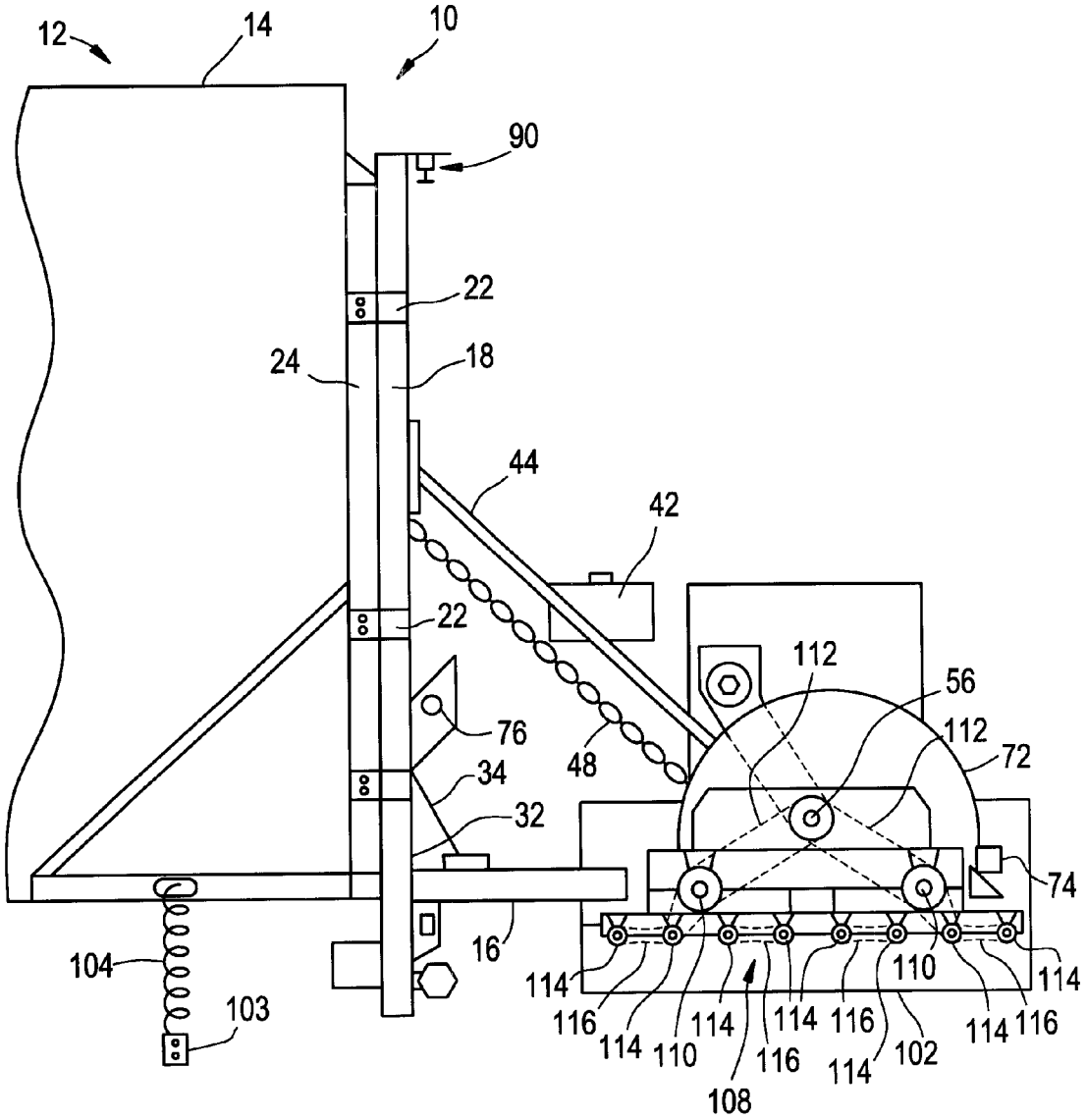
FIG. 8 is a schematic left end view of the system showing the embodiment that produces rumble strips in the road surface.
Figure 9:
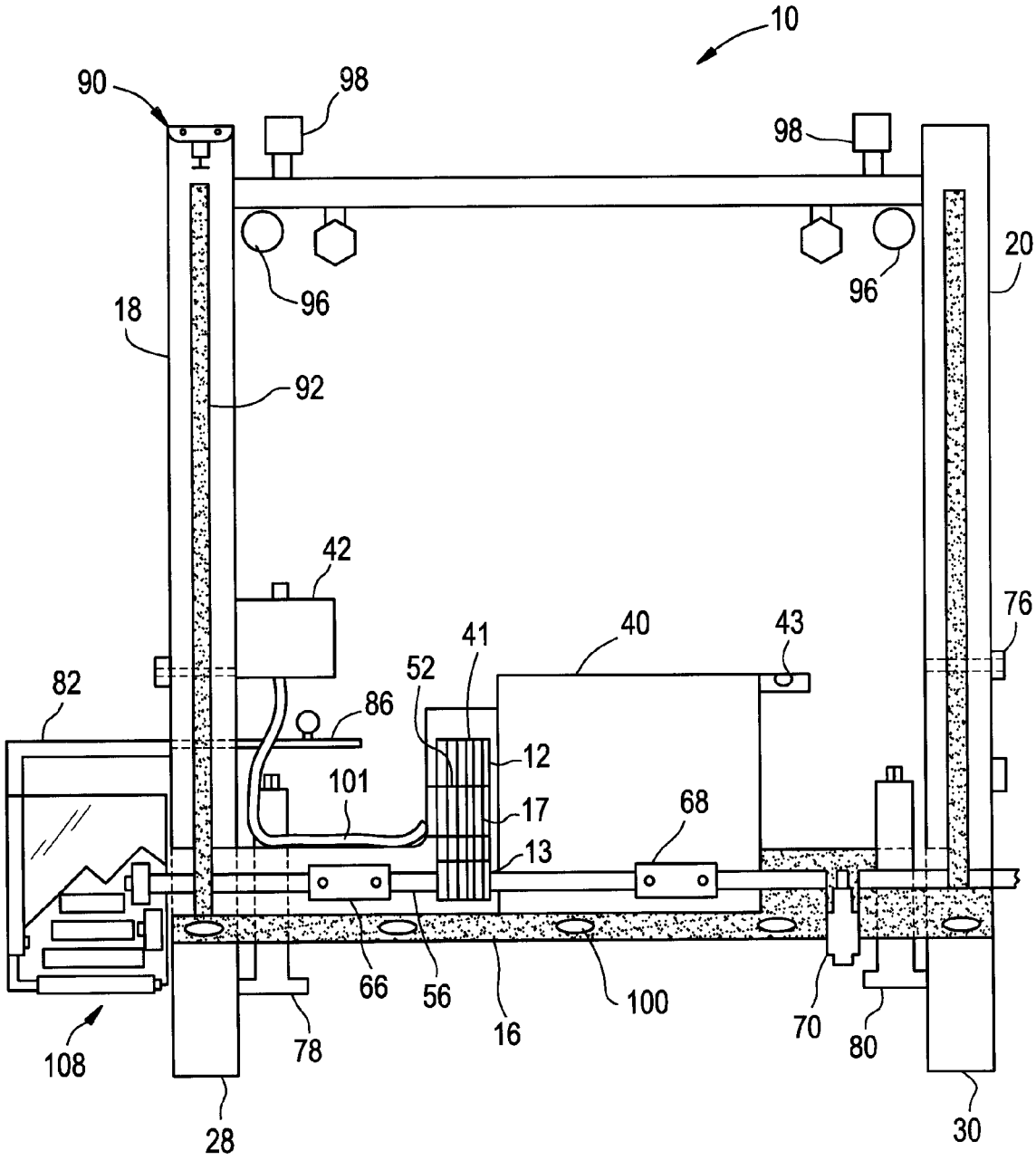
FIG. 9 is a schematic rear view of the embodiment of FIG. 8.

Turning now to FIGS. 8 and 9, there is shown an alternate embodiment of the present invention and where the system 10 is used to mill rumble strips into the surface of the road. As shown in this Figure, the power shaft 56 operates a multi-head cutting tool 108 that can be used to mill a plurality of grooves in the surface of the road simultaneously in order to create a rumble strip. In this embodiment, the power shaft 56 can rotate two secondary pulleys 110 by means such as belts 112 which, in turn may operate two cutters each, 114 that, in turn operate additional cutters 114 through a series of belts 116. In this manner, the power shaft 56 rotating in a horizontal plane can operate the plurality of cutters 114 to mill the grooves in the road to produce rumble strips. Again, in accordance with the spirit of the present invention, the use of the lift gate 16 is utilized to move the multi-head cutting tool 108 vertically to determine the depth of the various grooves and that operation to establish that depth is readily controlled by the operator by means of the control box 103.

Figure 10:
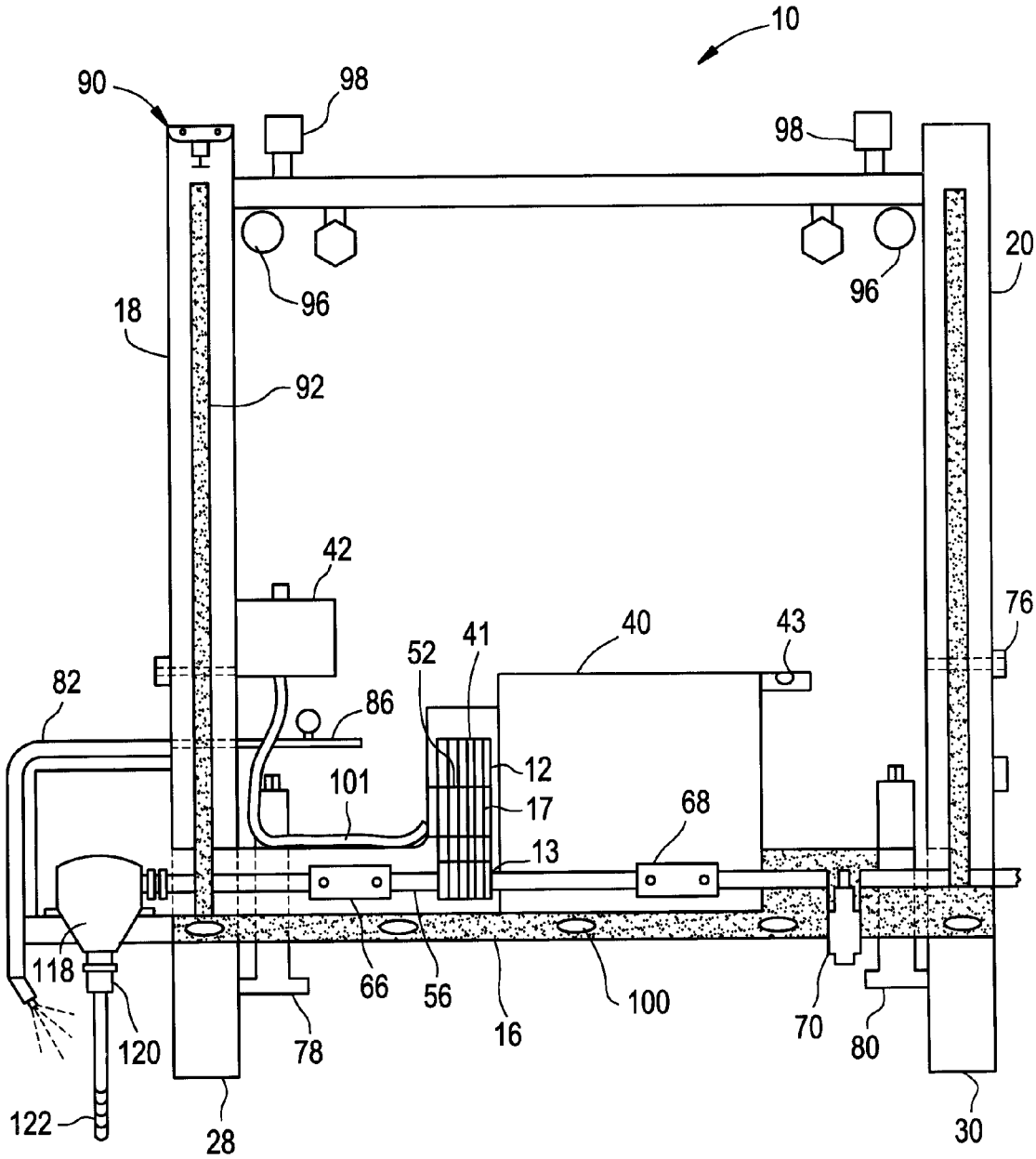
FIG. 10 is a schematic rear view of a further embodiment of the subject intention that is employed to bore holes in the road or excavate potholes.
Figure 11:
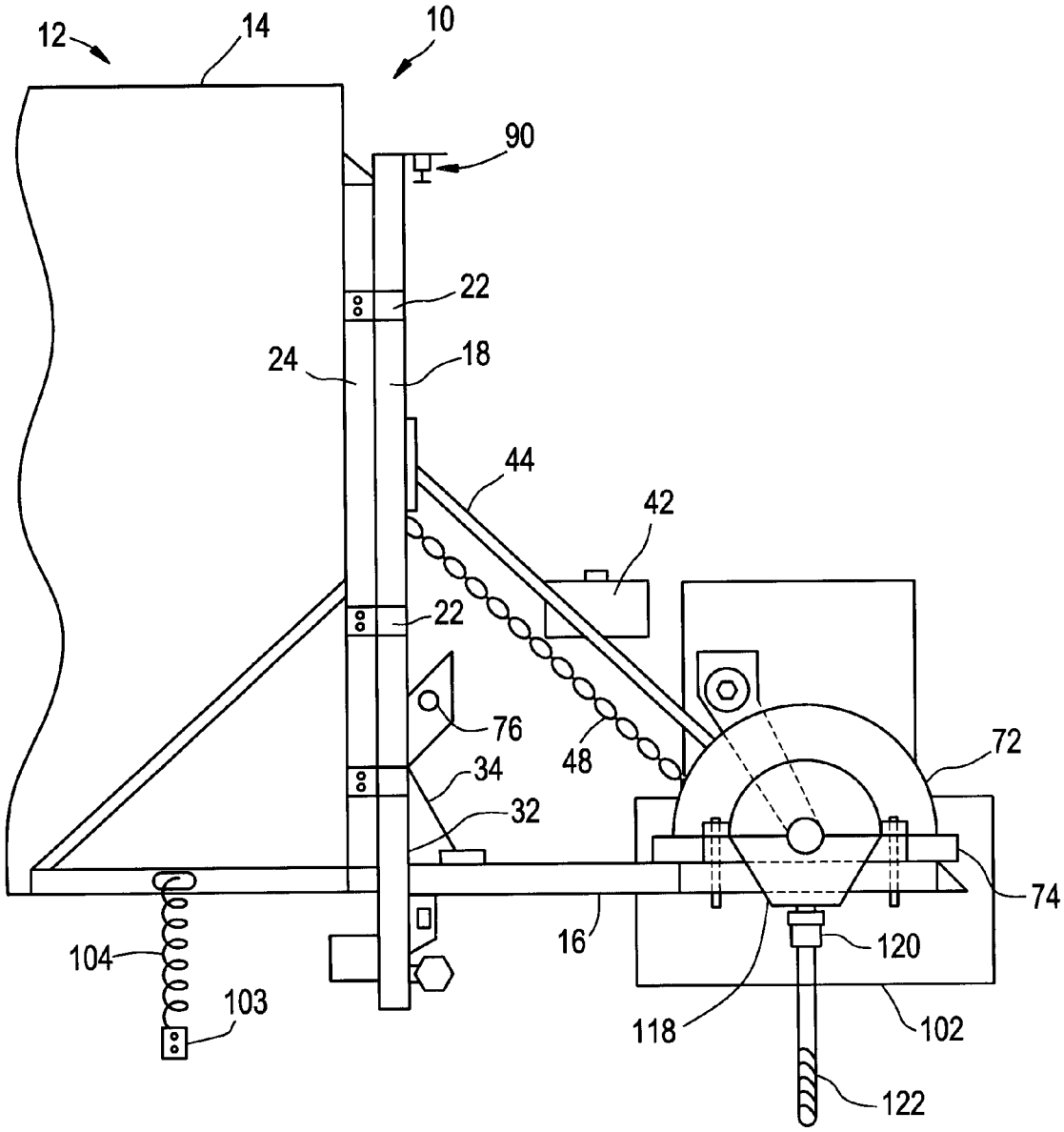
FIG. 11 is a schematic rear view of the embodiment of FIG. 10.

Finally. Turning to FIGS. 10 and 11, there is shown a still further embodiment of the present intention and where the system 10 can be used to bore holes in the road for various purposes, such as the securing a variety of structures to the road, such as, but not limited to, different styles of reflectors. In this embodiment, a differential 118 is used to convert the horizontal rotation of the power shaft 56 to a vertical rotation so that the apparatus can bore holes generally vertically into the road surface. A coupling 120 of conventional design allows the attachment of a boring bit 122 of differing sizes to account for the variety of operations on the road that involve the boring process and therefore any number of differing sizes of boring bits can be used.

While the present invention has been set forth in terms of specific embodiments thereof, it will be understood in view of the instant disclosure, that numerous variations upon the invention are now enabled to those skilled in the art, which variations yet reside within the scope of the present teaching. Accordingly the invention is to be broadly construed and limited only by the scope and spirit of the claims now appended hereto.

What is claimed is:

1. In combination with a vehicle having a motor powered mechanism for operating a vertically movable rear lift gate having an upwardly facing platform and a bottom surface which in use resides in a substantially horizontal plane; a system for working on a road surface; said system comprising:

a road surface working apparatus secured to the upward facing platform of said lift gate and having a working portion thereof being mounted on a rotatable drive shaft extending laterally of said gate and said working portion projecting below said bottom surface of the lift gate, whereby with said gate in a lowered position, said working apparatus can engage the surface of the road on which said vehicle rests;

motor means, secured to said gate, and connected to power said drive shaft; and means to selectively adjust the vertical position of said lift gate with respect to the surface of the road by controlling said motor powered mechanism, to thereby control the vertical position of the working apparatus and thus the degree of excavation produced by said working apparatus in the road.

2. A system as defined in claim 1 wherein said working apparatus comprises a plurality of milling cutters.

3. A system as defined in claim 1 wherein said rotatable drive shaft is positioned in a generally horizontal plane and said working apparatus comprises a differential to convert said rotation of said drive shaft to a bore bit rotatable in a generally vertical plane.

4. A system as defined in claim 3 wherein said bore bit is coupled to said differential to be readily replaced with differing size bore bits.

5. A system as defined in claim 1 wherein said working apparatus comprises a milling saw adapted to mill potholes formed the road.

6. A system for excavating cavities in the surface of a road, said system adapted to be used with a vehicle having a motor powered mechanism for operating a vertically movable rear lift gate having a substantially horizontal platform which has an upwardly facing surface; said system comprising:

a rotatable drive shaft mounted to said upwardly facing surface of said horizontal platform and motive means to controllably cause rotation of said rotatable shaft, said rotatable shaft having one end thereof laterally overhanging said upwardly facing surface, a cutting apparatus affixed to said one end of said rotatable shaft and extending below the bottom surface of said horizontal platform so as to rotate to cut the surface of a road, and means to control said motor powered mechanism for operating said lift gate to move said vertically movable lift gate in a vertical direction to selectively and controllably control the engagement of said cutting apparatus with the surface of the road and to control the depth of excavation caused by said cutting apparatus into the surface of the road.

7. A system as defined in claim 6 wherein said cutting apparatus comprises a plurality of milling saws having inner milling saws and outer milling saws spaced alongside each other, wherein said outer milling saws are of a larger diameter than said inner milling saws.

8. A system as defined in claim 6 wherein said rotatable shaft is mounted to said upwardly facing surface of said horizontal platform having its main axis of rotation generally horizontal.

9. A system as defined in claim 6 wherein said cutting apparatus comprises a rotating shaft having a generally vertical axis of rotation adapted to bore holes in the road.

10. A system as defined in claim 6 wherein said cutting apparatus comprises a plurality of generally parallel cutting blades adapted to simultaneously form a plurality of indentations in the road.

* * * * *